US005224627A

United States Patent [19]

Weag

[11] Patent Number: 5,224,627

[45] Date of Patent: Jul. 6, 1993

[54] METERING PUMP DISPENSER FOR LIQUID AND/OR PASTY MEDIA

[75] Inventor: Ernst Weag, Villingen-Schwenningen, Fed. Rep. of Germany

[73] Assignee: Firma Raimund Andris GmbH & Co., KG., Villingen-Schwenningen, Fed. Rep. of Germany

[21] Appl. No.: 901,413

[22] Filed: Jun. 19, 1992

[30] Foreign Application Priority Data

Jun. 22, 1991 [DE] Fed. Rep. of Germany ..... 4120644

[51] Int. Cl.[5] ..... B05B 7/04

[52] U.S. Cl. ..... 222/135; 222/145; 222/183; 239/600

[58] Field of Search ..... 222/135, 137, 145, 144.5, 222/153, 255, 256, 326, 380, 494; 239/414, 600

[56] References Cited

U.S. PATENT DOCUMENTS

| | | | |
|---|---|---|---|
| 4,438,871 | 3/1984 | Eckert | 222/137 |
| 4,773,562 | 9/1988 | Gueret | 222/135 |
| 4,949,874 | 8/1990 | Fiedler | 222/135 |

FOREIGN PATENT DOCUMENTS

| | | |
|---|---|---|
| 3614515A1 | 11/1987 | Fed. Rep. of Germany . |
| 3837704A1 | 5/1990 | Fed. Rep. of Germany . |
| 3843759A1 | 7/1990 | Fed. Rep. of Germany . |

*Primary Examiner*—Jesus D. Sotelo

*Attorney, Agent, or Firm*—McGlew & Tuttle

[57] ABSTRACT

The metering pump dispenser serves for simultaneous metered output of liquid and/or pasty media from at least two separate supply chambers (18, 19), which are arranged in a common pump housing (2) and to which are assigned individual separate metering pumps (5, 6), each with an intake and output valve (23, 24). The metering pumps are manually driven by a common actuating device (3), which extends on the side of actuation in a common front side of the metering pumps (5, 6) that are present and is provided with one or more output channels (57, 58). Metering pumps (5, 6) each have as pump devices communication bellows (21, 22) which are joined on the housing side with pump housing (2) and on the output side with the common actuating device (3). Actuating device (3) is a lever-type device mounted in a swiveling manner around a swivel seat (11) on one side in a head part (10) of pump housing (2) axially projecting over supply containers (18, 19), for conducting limited pump strokes. Swivel axis (11') of swivel seat (11) is arranged crosswise to a common plane of symmetry (20) of metering pumps (5, 6), so that metering pumps (5, 6) have variable distances and variably large actuation levers to the swivel axis (11'), and upon actuation of actuating device (3), pump strokes of different magnitude can be introduced in a specific, preselectable ratio at the same time and in the same direction.

31 Claims, 2 Drawing Sheets

METERING PUMP DISPENSER FOR LIQUID AND/OR PASTY MEDIA

FIELD OF THE INVENTION

The invention concerns a metering pump dispenser for simultaneously metered outputs of liquid and/or pasty media from at least two separate supply chambers. The two supply chambers are arranged in a common pump housing and are assigned individual separate metering pumps. Each metering pump has an intake and output valve, which can be actuated manually by a common actuation device. The actuation device extends on a common front side of the metering pumps that are present, on the actuation side, and is provided with one or more output channels.

BACKGROUND OF THE INVENTION

Substances are often used in the pharmaceutical, cosmetic, and also in technical industries, which consist of two or more components. These substances are characterized by the fact that they cannot be stored or can only be stored to a limited extent in the mixed state. This is true, for example, for synthetic resins, which are provided with a hardener in the pourable state, so that they harden after a certain reaction time.

However, there are also cosmetic substances, which should be brought together only during or directly before application in order to develop specific properties.

In the case of these two-component substances, as a rule, a specific mixing ratio of the two components is to be maintained in order to obtain, e.g., a sufficiently long processing time and/or a possibly complete reaction of the two material components. In the mixed state, such substances cannot be stored, since the chemical reaction generally occurs in an irreversible way and ensues directly after mixing the two components. It therefore happens that these two components are dispensed in a specific mixing ratio directly before the processing or application. The two material components are usually stored in separate containers and are removed from these containers in the appropriate proportions and dispensed for direct subsequent mutual processing.

Pump dispensers of this type are known, by means of which it is possible to obtain a prescribed mixing ratio of the two components, even if different total quantities are required. These pump dispensers have two metering pumps, which simultaneously feed two material components from supply containers associated with the metering pumps, upon actuating a common actuation unit.

A pump dispenser of this type is known from German patent DE-A 3,614,515 and consists of an essentially oval connection cap, which is provided on the underside with two connection cylinders arranged next to each other. The connection cylinders essentially determine the oval outer contour of the connection cap and are each provided with an inner threading into which a supply container with its bottleneck-type connection fittings is screwed. The distance between the connection cylinders is thus selected such that the supply containers can be screwed in individually and independent of one another. The connection cap has on the upper side lying opposite the connection cylinders an oval ring or piston land surrounding the connection cylinders and axially projecting upward.

A feed pump is plugged into the uptake cylinder from the threaded side. The supply containers and the metering pumps associated with them are coaxially arranged next to each other and lie in the common longitudinal central plane of the connection cap. The feed pumps are provided on the upper side with an outlet tube, which open up each time into an output channel of the common actuating device. The outlet tubes of the metering pumps are thus attached by means of a catch connection in the respective output channel. The actuating device is adapted in its form to the oval shape of the connection cap, whereby it is provided with an outer wall aligned toward the bottom, which is completely immersed in the ring land of the connection cap. An outlet channel leads from the outlet tubes of the feed pumps each time to a common outlet opening of the actuating device. In another variant, these two outlet channels of the actuating device open up into outlet nozzles each arranged separately from the other, the output openings of which are arranged in the direct vicinity of each other.

When the actuating device is compressed, both feed pumps are actuated simultaneously, so that the two material components are simultaneously supplied to the outlet opening from the supply containers through the respective outlet channel. In one complete pump stroke up to the stop on the under side of the outer wall of the actuating device on the upper side of the connection cap, each of the two metering pump feeds a maximum quantity of material components, whereby these quantities are related by the respective pump volumes of the metering pumps in a specific ratio which is given beforehand and unchangeable. Since the actuating device is only plugged onto the outlet tube of the two metering pumps and guide elements are not provided, which respectively hinder a tilting or an oblique compression of the actuating device, a uniform and simultaneous feed stroke of the two metering pumps is possible only under certain conditions.

The pumps each travel the same feed path, i.e., beginning simultaneously with pressure on the actuating device with the feed stroke, and also travel the same path during the stroke motion, so it is necessary that the actuating device is actuated symmetrically to the feed pumps arranged next to each other. In the case of an asymmetric actuation of the actuating device, the beginning of feed of one metering pump occurs prior to the beginning of feed of the neighboring metering pump. This leads to different mixing ratios of the two material components in the case of small output quantities, such as if a complete feed stroke is not carried out. The two metering pumps travel the same feed stroke, i.e. the maximum stroke, and deliver substantially equal amounts only if the actuating device is completely compressed up to the stop. Only in this case can a pregiven mixing ratio be maintained. This means that with small feed quantities, i.e., in the case of a feed stroke that is smaller than the maximum, and, for example, with asymmetric actuation of the actuating device, the desired mixing ratio cannot be assured due to the different pump paths of the two feed pumps.

Further, a change in the mixing ratio of the two material components is possible exclusively due to the use of metering pumps with different maximum stroke volumes. That is, for a change in the mixing ratio, it is necessary to exchange at least one of the metering pumps completely for a metering pump with another stroke volume, whereby the pump dispenser must be almost completely dismantled. A variable use of this known pump dispenser is thus not possible without great expense, since several different metering pumps must be prepared for different mixing ratios and their exchange is associated with a number of assembly steps.

A paste dispenser is also already known from U.S. Pat. No. 4,438,871, which does not have a communication bellows as a pump device, but rather two manually actuatable pump pistons. The pump pistons take in two different media simultaneously, in cooperation with intake valves, from two paste containers lying concentrically within one another, but separate. Each of the two paste containers is provided with a lagging piston and supply the media via separate channels into a backup space, which is arranged directly in front of an outlet opening. This backup space surrounds a tappet-type closing organ which is arranged on an elastic membrane wall loaded by the feed pressure of the medium.

The two pump pistons are arranged coaxially to each other, joined rigidly together and are provided with a common actuating device, which is manually actuated. In order to pump different quantities, the pump pistons are provided with different diameters. The cylindrical pump chambers which are also coaxial and are combined with the separate paste containers by means of intake valves. Two separate conduction channels join the cylindrical pump chambers by separate outlet valves. These channels run axis-parallel and are arranged eccentrically to the pump chambers and open up into the backup space. In this way a labyrinth-type shape of the space is produced of the pump chambers and conduction channels that are joined together. The manufacturing technology for this pump device can only be realized with difficulty and at high cost, so that this device is unsuitable for mass production, especially if it is a so-called disposable article.

In other known two-component paste dispensers, U.S. Pat. Nos. 4,773,562 and 4,949,874, the pump organs consisting of pistons are arranged parallel to each other in a container head and can be actuated jointly by means of a bridge-type actuating device with the same size stroke and with the same stroke volume. In one of these two paste dispensers, U.S. Pat. No. 4,949,874, there is also the possibility of actuating the two pistons individually.

In addition, two-component metering dispensers are also known from German Unexamined patent disclosures DE-OS 3,837,704 and 3,843,759, which have a communication bellows as the pump organ. In this case, however, the second component is added to a first quantity-dominant material component only in small, rigidly prescribed quantities, e.g., in strip form. The quantity ratio cannot be varied. The metering dispensers in DE-OS 3,837,704, provides a communication bellows with an intake and an outlet valve for the primary material component and a feed piston for the second material component. This piston is loaded by the primary material component and is arranged in a cylindrical container space filled with the second material component. In the other metering dispenser, DE-OS 3,843,759, the communication bellows itself is filled with the second material component, which it provides to the output channel by means of secondary channels. The primary material component, however, is conducted through a tube channel that is essentially greater in its cross section and coaxially projects through the communication bellows. The quantity ratios between the two material components also cannot be influenced in a controlled manner in this case. Rather, the prescribed quantity ratio is maintained only somewhat precisely for these two-component metering dispensers, if a complete actuation stroke is carried out and the two materials have at least approximately the same viscosity.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

SUMMARY AND OBJECTS OF THE INVENTION

The invention is based on the task of creating a metering pump dispenser of the above type, which consists of as few individual parts as possible, in which a mixing ratio of two material components may be varied with means that are as simple as possible, and in which the selected mixing ratio of the material components remains constant during the entire stroke motion.

The task is solved according to the invention in that there are communication bellows which serve as pump organs. These communication bellows are joined on a housing side with a pump housing and on an output side with a common actuating device. The actuating device is seated in a swiveling manner around a swivel seat, on one side for conducting limited pumping strokes and is a lever-type seated in a head part of the pump housing projecting axially over the supply chambers. The swivelling axis of the swivel seat is arranged crosswise to a common plane of symmetry of the metering pumps and the metering pumps are placed at variable distance and with actuation levers of different lengths to the swivelling axis. The metering pumps carry out pump strokes of different size in a rigid, preselectable ratio to each other simultaneously and in the same direction upon actuation of the actuating device.

The metering pump dispenser of the invention has the advantage that the respective pump volumes and the output quantities of the metering pumps are constantly in the same ratio to each other, both in the case of a complete pump stroke as well as in an only partially conducted pump stroke of the actuating device. It is assured by the lever-type seating of the actuating device in a swivel seat, whose bearing axis runs crosswise to the common plane of symmetry of the metering pumps, that the beginning of feed of the two metering pumps is produced simultaneously upon compression of the actuating device. Further, the stroke paths of the metering pumps are constantly at the same ratio to each other during the entire pumping process with respect to pump motion, whereby this ratio is determined by the specific actuating levers of different lengths.

Since all the parts which are required for the pumping process are arranged in the head part of the pump housing, the adjustment of different pump volumes of the metering pumps and thus of the mixing ratio of the material components can be conducted by a simple exchange of one or all communication bellows, without the need for fully dismantling the pump dispenser or the metering pumps. Thus it is assured that a specific pre-given mixing ratio of the two material components can be varied in a simple way and can be maintained assuredly independent of the size of the actuation path of the actuating device.

The metering pumps have output valves and input valves. The output valves have an output valve seat and an output valve disk. The output valve seat, in a preferred embodiment, is formed in one piece with the common actuating device. The output valve seat tapers conically to the communication bellows and is connected to a substantially cylindrical fitting. The output valve disk cooperates with the output valve seat and has guide ribs which guide the output valve disk in the substantially cylindrical fitting of the output valve. This embodiment makes possible a simple assembly of the metering pumps and particularly of the output valves, whereby the greatest possible functional reliability is also assured.

It is assured by another embodiment that the outlet nozzle changes its relative position to the pump housing only to a small extent upon actuation of the actuating device, whereby the manipulation of the metering pump dispenser is essentially simplified.

By the embodiment of the nozzle having separate nozzle channels, e.g., hardening of the mixtures of the material components solidify in the output nozzles and stopping these up, is effectively prevented since the intermixing is conducted only outside the output nozzles.

The arrangement of the nozzle channels having different cross sectional areas makes possible the output of various material components in the smallest space, so that losses or unintentional changes in the mixing ratio are avoided in the intermixing after output.

A direct linear course of the output channels is achieved in an embodiment of the invention, so that outlet channels can be produced in a cost-favorable manner in a simple way.

An intermixing of the two different material components can be obtained, if need be, prior to the outlet from the output nozzles by combining the output channels before the nozzle, whereby at the same time a point-precise output of the material components is possible.

The intake valves of the metering pumps have an intake valve seat and an intake valve disk. The intake valve seat can be formed from a domed-shaped cylinder section formed in one piece with the pump housing. The intake valve seat has a tube segment conically tapering to a supply chamber and connected to a cylindrical intake tube. The intake valve disk is provided with guide ribs and the intake valve disk is guided in the cylindrical intake tube by the guide ribs. Safety catches project from the dome-shaped cylinder section and into the communication bellow. The safety catches have stops directed radially inward for bounding an opening stroke of the intake valve disk. The intake valve disk is provided with a central mounting pin projecting into the communication bellows for ease of assembly of the intake valve disk passed the safety catches and against the intake valve seat. This embodiment assures low manufacturing costs with simultaneously simple assembly both of the intake valves and the communication bellows, based on the small number of structural parts. In addition, a high functional reliability and service life are assured by the simple construction of the intake valves.

The pump housing is provided with two separate cylindrical hollow spaces open on the underside for the uptake of exchangeable supply containers. The advantage results by this embodiment, that after consumption of the two components, the supply containers can be exchanged in a simple way and in this way the metering pump dispenser can be used again.

An unintentional loosening of the supply container in the pump housing or a damaging of the supply container by inappropriate handling is almost totally excluded by adapted the depth of the hollow spaces to the length of the supply containers.

The intake tube of the intake valve can be provided with outer threading for screwing on a supply container and/or the dome shaped cylindrical section of the pump housing is provided with an inner threading for screwing on a supply container. This embodiment assures, in addition, a secure tight seating of the exchangeable supply containers in the pump housing of the metering pump dispenser.

The common actuating device can have an edge which cooperates with an upper edge of the pump housing in order to limit the travel of the common actuating device. By these embodiments the actuating device can be rapidly and simply assembled and disassembled by a simple catching in the head part of the pump housing, so that if the need should arise, a necessary exchange of a communication bellows can be conducted in a simple way in order to obtain another mixing ratio.

The common actuating device is connected to the pump housing by a swivel seat, or swivel means. The swivel seat is shaped like a tongue-and-groove joint or catch cavities can be arranged on the underside of the common actuating device. These catch cavities cooperate with rods arranged in a head part of the pump housing. The rods are latched in the catch cavities in a rotatable manner. It is achieved by this embodiment that upon application of the actuating device in the head part of the pump housing, the respective bearing elements are engaged with each other at the same time, whereby assembly costs are also reduced.

In another embodiment of the present invention, several demountable rods are fabricated in the swivel means. These several demountable rods can be made in one piece with a bearing piece in the front wall of the pump housing. These several demountable rods are arranged in coaxial pairs and correspond in position with the catch cavities. By this embodiment, it is obtained that the different mixing ratios can be preselected in a simple way by the selection of different ratios of the actuating levers for the two metering pumps.

Instead of having several demountable rods in the bearing piece, the bearing piece can have additional catch cavities or cross bore holes. A loose bearing pin in then placed into the cross bore holes another catch cavities and this loose bearing pin then cooperates with the catch cavities of the common actuating device. This embodiment makes possible a multiple change of the lever ratio, whereby the pump strokes of the metering pumps can be differently adjusted in their ratio to each other at any time.

The invention is explained in more detail in the following on the basis of the drawing. Here:

DETAILED DESCRIPTION OF THE PREFERRED EMBODIMENT

Figure 1:
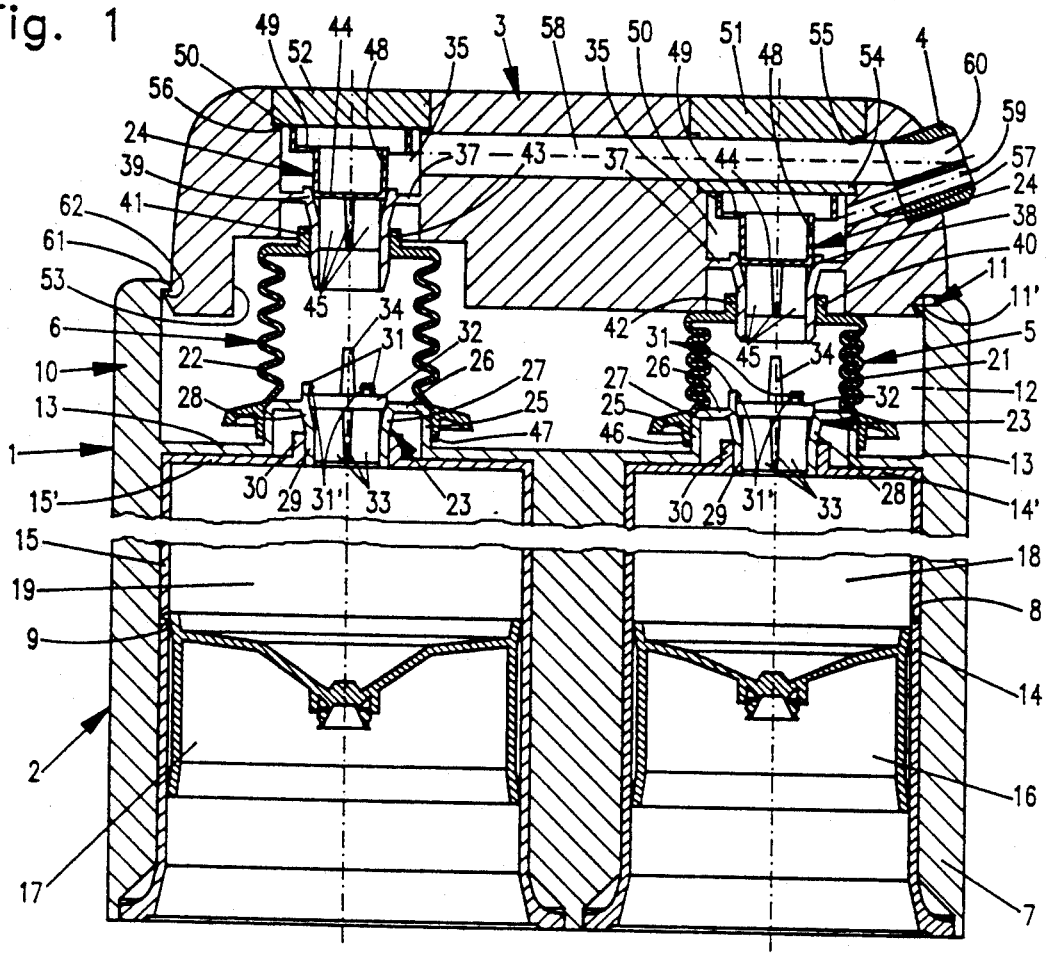
FIG. 1 shows a metering pump dispenser in longitudinal section.

The metering pump dispenser shown in longitudinal section in FIG. 1 essentially consists of a pump housing 2, an actuating device or lever 3, an output nozzle 4, and two metering pumps 5, 6. Pump housing 2 displays a foot part 7, which is provided with two separate cylindrical hollow spaces 8 and 9, each of which have different diameters.

Actuating device 3 is a lever type in a head part 10 axially projecting over hollow spaces 8, 9 of the foot part 7 mounted in a swiveling manner around a swivel seat or means 11, whose swivel axis 11' runs crosswise to a common plane of symmetry of the two metering pumps 5, 6. Hollow spaces 8, 9 and inside space 12 of head part 10 are separated from each other by a front wall 13 of the housing.

In each of the hollow spaces 8, 9, a supply container 14, 15 is inserted such that it lies on its front side at front wall 13 of the housing. The inner dimensions of hollow spaces 8, 9 are fitted to the outer diameters of supply containers 14, 15, such that the latter can be inserted into the respective hollow spaces 8, 9 with an easy sliding fit. The air compressed in the insertion of supply containers 14, 15 leaks out through valves 23, 24 of metering pumps 5, 6, so that air cushions cannot form in hollow spaces 8, 9. In order to reliably avoid the formation of an air cushion, hollow spaces 8, 9 may be provided with ventilation boreholes or with a ventilation groove arranged in the wall of the hollow space (not shown in the drawing). In this way the dismantling of supply container 14, 15, is also simplified, since no reduced pressure can form in hollow spaces 8, 9 when supply containers 14, 15 are pulled out.

In another form of embodiment, not shown in the drawing, the dome-type cylinder sections 25 are each provided with an internal threading, into which can be screwed the respective supply container 14 or 15 with its output connection 30 having an outer threading fitted to this. It is also conceivable, that instead of the internal threading in cylinder sections 25, the intake tubes 29 of intake valves 23 are each provided with an outer threading, which also serves for the screwing on of a supply container 14, 15.

The screw connections between supply containers 14, 15 and pump housing 2 have the advantage that supply containers 14, 15 can be utilized with radial play in hollow spaces 8, 9 and their rigid and tight seating is secured by the thread connection, so that no special measurement tolerance must be provided for the internal dimension of hollow spaces 8, 9, and supply containers, 14, 15 are essentially easily exchangeable. In addition, no special ventilation devices must be provided in order to reliably avoid the formation of an air cushion during insertion or the formation of an underpressure upon removal of supply containers 14, 15.

The two supply containers 14, 15 are each provided with a lagging piston 16 or 17, which bound the respective supply chamber 18 or 19 of supply container 14 or 15 in the axial direction downwardly on the side of the foot part.

Figure 2:
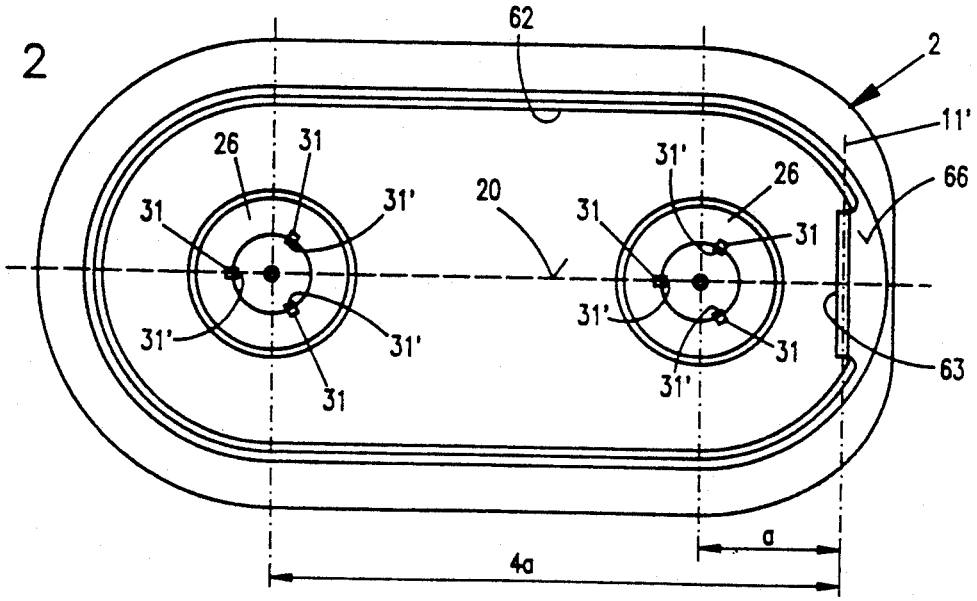
FIG. 2 shows the pump housing of the pump dispenser with detached actuating device in top view.

The external form of pump housing 2 is determined by the size and arrangement of supply containers 14, 15. It is essentially oval in cross section (FIG. 2). Supply containers 14, 15 are arranged in a common vertical plane, which is also the vertical longitudinal central plane and plane of symmetry 20 of pump housing 2.

Metering pumps 5, 6 are arranged coaxially to the respective supply containers 14, 15 above front wall 13 of the housing in head part 10 of pump housing 2. Metering pumps 5, 6 are essentially equal in construction and each have a communication bellows 21, 22 as the pumping device. In addition, metering pumps 5, 6 are each provided with an intake valve 23 and an output valve 24.

Intake valves 23 are integrated into front wall 13 of the housing as elements of pump housing 2. Front wall 13 of the housing is provided each time with one dome-type cylinder section 25 arranged coaxially to supply containers 14 or 15. This section 25 has a separating wall 26 on the front side. Separating walls 26 are each provided with a valve seat 27 which has a tube section 28 tapering conically to the respective supply container 14 or 15. Individual cylindrical intake tubes 29 are connected to both tube sections 28, and onto the intake tubes 29 the respective supply container 14 or 15 with an output connection 30 is tightly mounted.

Valve seat 27 of the respective intake valve 23 is provided with three safety catches 31 formed in one piece, which project over separating wall 26 toward the top in the axial direction on the side of the head part, and which have stops 31' directed radially inward on their upper ends.

Intake valves 23 are each provided with an axially moveable valve disk 32, which in its position of rest is tightly applied to the respective valve seat 27 with its rotating lower outer edge. On its underside, valve disk 32 is provided with radial guide ribs 33 projecting into the respective intake tube 29, by which means the valve disk 32 is guided in intake tube 29. On its upper side, valve disk 32 has a central mounting pin 34, which serves for the simple manipulation of valve disk 32 upon latching the three safety catches 31. In the assembled state, valve disk 32 can be seated in an axially moveable manner between valve seat 27 and stop 31' of safety catches 31, whereby it is radially guided, on the one hand, by guide ribs 33 in intake tube 29, and on the other hand, with its jacket surface on safety catches 31 below stops 31'.

Stops 31' of safety catches 31 have a distance to the valve seat 27, which permits a sufficient path for opening valve disk 32 for releasing the intake opening in valve seat 27, so that intake valve 23 operates reliably and free of disturbance.

The dome-type cylinder sections 25 with their respective outer jacket surfaces serve for the uptake of the respective communication bellows 21 or 22. Communication bellows 21, 22 each have on their lower ends a cylindrical, radial elastic annular wall 46, 47, which tightly and snugly surrounds the jacket surface of the respective dome-type cylinder section 25.

Output valves 24 are each arranged in a cylindrical recess 35 in actuating device 3 as an integral element. Recess 35 is provided approximately in its lower third with a piston land 37 on which a valve seat 38 or 39 is formed in one piece and in a conically tapering manner to the underside of actuating device 3. Fittings 40 or 41 are connected to each of valve seats 38, 39. These fittings are surrounded snugly and tightly by an upper, radial-elastic front-wall collar 42, 43 of the communication bellows 21 or 22.

Figure 8:
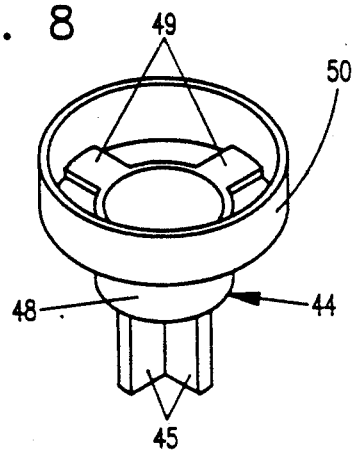
FIG. 8 shows a valve disk of an output valve in a perspective representation.

Output valves 24 are also provided with valve disks 44, which have radial guide ribs 45 also on their underside (FIG. 8), by means of which they are guided in fittings 40, 41. On the upper side lying opposite guide ribs 45, the valve disk 44 is provided with a support cylinder 48, which is joined each time by means by of spring-elastic radial crosspieces 49 with an annular wall 50 coaxial to support cylinder 48 and greater in diameter.

Output valve 24 of metering pump 5 is arranged on the side of the swivel seat in actuating device 3 at a distance a from swivel seat 11. Output valve 24 of metering pump 6 has a distance to swivel seat 11, which corresponds to approximately 4 times the distance a (FIG. 2). The output valve 24 on the side of the swivel seat is arranged in a displaced manner to communication bellows 21 opposite the other output valve 24 away from the swivel seat, so that its piston land 37 is found approximately in the lower fourth of actuating device 3. On the other hand, output valve 24 of metering pump 6 away from the swivel seat is arranged in a cavity 53 of actuating device 3, so that its piston land 37 lies axially approximately in the center of actuating device 3.

Recesses 35 for uptake of output valves 24 are each closed with a valve cover 51 or 52, which is tightly pressed from the top into the respective recess 35. The front sides of annular walls 50 are applied to the respective underside of valve covers 51, 52, so that valve disks 44 are supported with a slight pressure on the respective valve seat 38 or 39 by means of the axial spring-elastic radial crosspieces 49 and their respective support cylinders 48. Since the output valve 24 on the side of the swivel seat is arranged in the lower third of actuating device 3, valve cover 51 is introduced in an offset manner to valve disk 32 and is provided with a cylinder section 54 which is smaller in diameter on this side. For precise axial positioning of valve disks 51, 52, recesses 35 are each provided with a surrounding annular shoulder 55, 56. Valve cover 52 of the output valve 24 away from the swivel seat is supported with its lower edge on annular shoulder 56. Valve disk 51 has a surrounding shoulder at the base of its offset piece, by means of which it is applied to annular shoulder 55 of recess 35.

Directly underneath annular shoulders 55, 56, an output channel 57 or 58 each time leads from the respective recess 35 to output nozzle 34. The two output channels 57, 58 run in the plane of symmetry 20 of pump housing 2, which coincides with the longitudinal central plane of actuating device 3. Output channel 58 runs in a straight line above output valve 24 on the side of the swivel seat and passes through cylinder section 54 of valve cover 51. Output channel 57 of output valve 24 on the side of the swivel seat runs at an angle of inclination $\beta$ (FIG. 4) of approximately 10° upward to output nozzle 4.

Output channels 57, 58 are adapted in their cross section to the ratio of the pump quantities of metering pumps 5, 6 such that the respective pump media flow into output channels 57, 58 in the case of a pump process with the same flow velocity.

Figure 7:
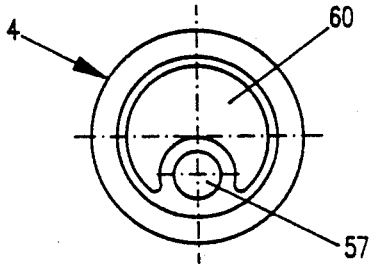
FIG. 7 shows an output nozzle in front view.

Output nozzle 4 has two nozzle channels 59 and 60, which are adapted in their cross section to output channels 57 and 58. The larger nozzle channel 60 thus partially surrounds, as is shown in FIG. 7, the smaller output channel 59, so that the two material components leave output nozzle 4 approximately at the same place. Output nozzle 4 is arranged at the same angle of inclination $\beta$ as the output channel of metering pump 5 on the side of the swivel seat, so that nozzle channel 59 runs coaxially to output channel 57.

Actuating device 3 is provided on the side lying opposite the swivel seat on its lower rotating edge with a stop shoulder 61 projecting outwardly. Head part 10 of pump housing 2 has in the same region on its upper rotating edge a stop edge 62 projecting inwardly on which actuating device 3 is applied with its stop shoulder 61 in the position of rest supported by the restoring force of communication bellows 21, 22.

Figure 3:
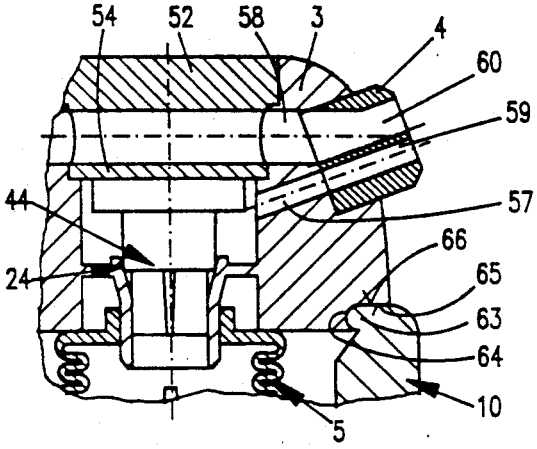
FIG. 3 shows a part of FIG. 1 in an enlarged scale.

As is shown in FIGS. 1–3, swivel seat 11 is formed as a type of tongue-and-groove engagement. The rib or spring-type bearing element 63 that is approximately semicylindrical in cross section has a linear course and is arranged on the upper inner edge of head part 10 crosswise to the plane of symmetry 20 of pump housing 2 (FIG. 2). A semicylindrical crosswise groove 64 of swivel seat 11 is arranged on the corresponding lower edge of actuating device 3 and is engaged with bearing element 63 of head part 10 in a swiveling manner. The outer contour of actuating device 3 and its stop shoulder 62 is adapted to the essentially oval form of the inner space 12 of head part 10, so that in the assembled state and in any swivelling position of actuating device 3, the latter is taken up in head part 10 in an approximately play-free manner.

The assembly of actuating device 3 in the head part is considerably simplified by the arrangement of stop shoulder 61 on the actuating device and stop edge 62 on head part 10 and the tongue-and-groove swivel seat 11. The actuating device is first engaged by its crosspiece groove 64 with bearing element 63 of head part 10. By simply pressing actuating device 3 into head part 10, stop shoulder 61 catches behind stop edge 62 and is thus mounted in head part 10 in a swivelling manner, but cannot become loose. In order to reliably prevent an accidental pressing through into the region of swivel seat 11, actuating device 3 is provided above its crosswise groove 64 with an additional stop surface 65, which comes to rest at front surface 66 of head part 10 during assembly.

Figure 4:
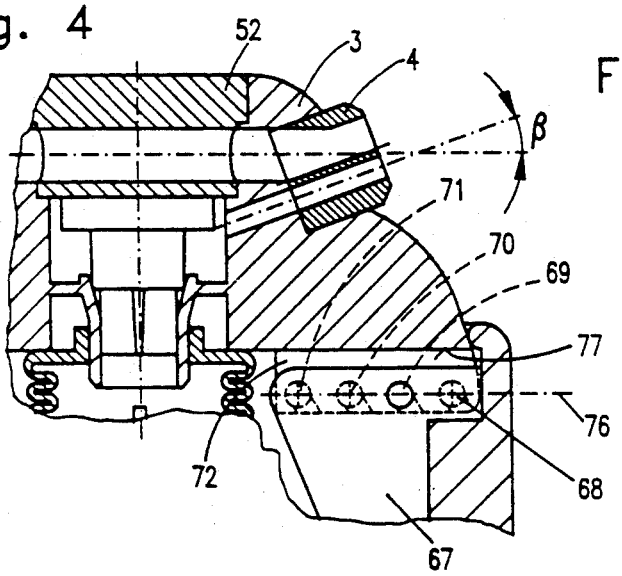
FIG. 4 shows another seating of the actuating device, in section.
Figure 5:
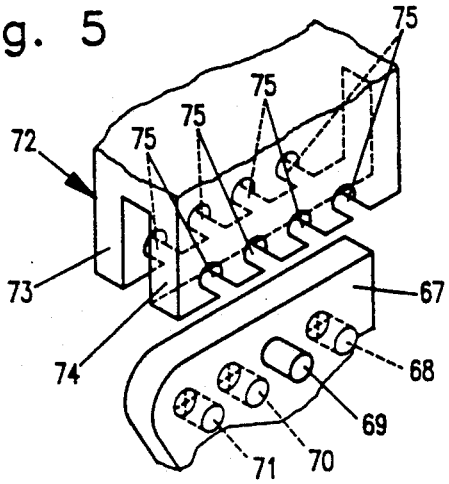
FIGS. 5 and 6 show the basic elements of two different rod mountings.
Figure 6:
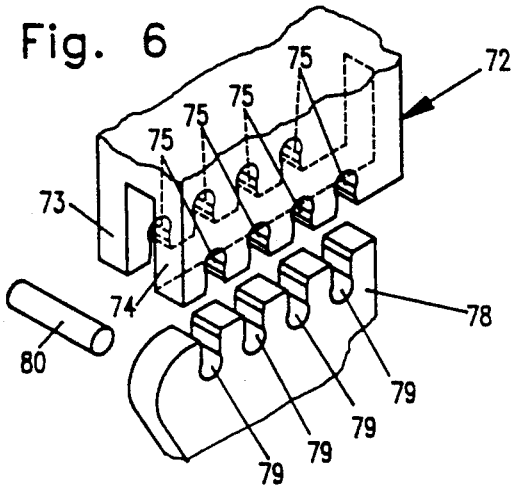

Other variants of swivel seat 11 as shown in FIGS. 4, 5, and 6 have a swivel position means for varying a position of the pivot point or swivel axis of swivel seat 11.

Swivel seat 11 shown in FIG. 4 and FIG. 5 consists of a bearing piece 67 arranged in inner space 12 of head part 10 in the vertical plane of symmetry 20. This bearing piece 67 is provided on both sides with several cross-running and paired coaxial rods 68, 69, 70, 71.

As a counter support, actuating device 3 is provided on its underside in the region lying underneath output nozzle 4 with a U-shaped double piece 72, whose individual catch pieces 73, 74 are arranged at a distance to each other which is fitted to the width of bearing crosspiece 67. Catch pieces 73, 74 are arranged symmetrically to the common plane of symmetry 20 of pump housing 2 and actuating device 3 and have on the bottom, open, coaxially paired catch cavities 75 arranged crosswise to the longitudinal central plane 20. Catch cavities 75 are arranged in a common plane 76, which runs parallel to the planar underside 77 of actuating device 3. The distances of rods 68, 69, 70, 71 and the paired catch cavities 75 are fitted to one another and are arranged in their position opposite actuating device 3 or head part 10 of pump housing 2, so that actuating device 3 is supported in head part 10 in the mounted state roughly in a play-free manner.

For assembly, the pairs of rods 68, 69, 70 or 71 in bearing piece 67, which are not necessary for obtaining specific lever ratios between swivel axis 11' and the two metering pumps 5, 6 are removed on both sides. As is shown, e.g., in FIGS. 4 and 5, a coaxial pair of rods 69 remains in bearing piece 67 and is engaged during assembly with catch cavities 75 lying opposite.

In order to obtain different pregiven lever ratios and thus different stroke ratios on metering pumps 5, 6, the respective pair of rods 68, 69, 70 or 71 in bearing piece 67 is inserted, or not removed. The respective pair of rods are then engaged with the opposite-lying catch cavity 75 so that specific mixing ratios of the two material components can be established.

The variant of the swivel seat shown in FIG. 6 is different from the embodiment of FIGS. 4 and 5 in that bearing piece 78 also arranged in head part 10 of pump housing 2 has open catch cavities 79 on top. As an additional bearing element, a bearing pin 80 is provided, which is caught centrally as desired in one of the catch cavities 79 of bearing piece 78 of pump housing 2, and which catches in a rotating manner, upon assembly, in the corresponding pair of catch cavities 75 of catch pieces 73, 74 of actuating device 3 and thus forms the swivel seat between actuating device 3 and head part 10.

Instead of catch cavities 79, correspondingly positioned cross boreholes can also be arranged in mounting piece 78, through which bearing pin 80 can be inserted.

This type of bearing shown in FIG. 6 has the advantage that pump dispenser 1 can be applied in a variable manner for different mixing ratios of the two material components and can be adjusted in a simple way at any time to another desired mixing ratio. In combination with the exchangeability of one of communication bellows 21, 22, the most varied mixing ratios can thus be selected, so that metering pump dispenser 1 of the invention can be used for mixing the most varied material components.

The sizes of supply containers 14 and 15 are adapted to the ratio of the displaced volumes of the two metering pumps 5, 6 as derives from FIG. 1. That is, supply container 14, which has a smaller supply chamber 18 than supply container 15, is joined with metering pump 5, while container 15 is joined with metering pump 6.

It is also possible that supply chambers 18, 19 are formed as a one-piece component of pump housing 2, so that there is no assembly process for the two supply containers 14, 15. In this case, the two lagging pistons, 16, 17 are arranged directly in the two cylindrical hollow spaces 8, 9.

Further, it should be mentioned that output nozzle 4 can be attached in an exchangeable manner, e.g., by means of a bayonet lock onto actuating device 3, whereby here also a variable application is possible by exchanging output nozzle 4.

What is claimed is:

1. Metering pump dispenser for substatiantially simultaneously metered output of liquid and/or pasty media from first and second supply chambers, the dispenser comprising:

a pump housing containing the first and second supply chambers, said pump housing having a head part;

first and second metering pumps respectively assigned to the first and second supply chambers, each of said first and second metering pumps having an intake and output valve, said output valves being respectively provided with first and second output channels, said first and second metering pumps having a respective first and second communication bellows, said first and second communication bellows being joined on a housing side with said head part of said pump housing;

actuating means for manually actuating said intake and output valves, said actuating means having a common actuating device which is connected to said pump housing and extends along said head part of said pump housing and along a common front side of said first and second metering pumps, said first and second communication bellows being joined on an output side with said common actuating device, said actuating means having a swivel means for pivotably connecting said common actuating device to one side of said head part of said pump housing and having said common actuating device carry out limited pump stokes in a lever type manner, said swivel means pivoting said common actuation device about a swivel axis substantially perpindicular to a substantially commom plane of said first and second metering pumps, said swivel axis being positioned at different distances from said first and second metering pumps in order to actuate levers of different size on said first and second metering pumps and to carry out substantially simultaneously and in substantially a same direction, differently sized pump strokes at a preselectable ratio upon actuation of said actuating means.

2. Metering pump dispenser according to claim 1, wherein: said output valves of said first and second metering pumps are each arranged in said common actuating device and joined with said respective communication bellows.

3. Metering pump dispenser according to claim 2, wherein: said output valves have a valve seat tapering conically towards said respective communication bellows, said valve seats being formed as a one-piece component with said common actuating device and said valve sets of said output valves having substantially cylindrical fittings.

4. Metering pump dispenser according to claim 3, wherein: said output valves have a valve disk as a moveable valve organ, said valve disk has a communication-bellows side on a lower front side with guide ribs, said guide ribs being guided in an axially moveable manner in one of said substantially cylindrical fittings.

5. Metering pump dispenser according claim 4, wherein: said valve disk has a support cylinder on an upper front side lying substantially opposite said guide ribs, said support cylinder being made in one piece and joined in an axially elastic manner with an annular wall, said annular wall being arranged coaxially to said support cylinder via a spring-elastic radial crosspieces.

6. Metering pump dispenser according to claim 5, wherein: said common actuating device defines first and second recesses positioned substantially coaxial to said substantially cylindrical fittings, each of said valve disks are respectively arranged in said first and second recesses, said first and second recesses being closed by means of respective first and second valve covers fitting in said respective first and second recesses, said annular walls of said output valves being supported in an axial direction by said respective first and second valve covers.

7. Metering pump dispenser according to claim 6, wherein: said first and second recesses of said output valves are each joined with an output nozzle by means of said output channels, each of said output channels forming a separate nozzle channel of said output nozzle.

8. Metering pump dispenser according to claim 7, wherein: said nozzle channels have a different cross section, and a larger of said nozzle channels at least partially surrounding a smaller one of said nozzle channels.

9. Metering pump dispenser according to claim 7, wherein: said output channels are positioned in said substantially common plane of symmetry of said first and second metering pumps.

10. Metering pump dispenser according to claim 7, wherein: said two nozzle channels open up into a common outlet channel.

11. Metering pump dispenser according to claim 1, further comprising: an output nozzle exchangeably attached to said common actuating device on a side common with said swivel means.

12. Metering pump dispenser according to claims 1, wherein: said output valve positioned closest to said swivel means is arranged in a displaced manner axial to said respective communication bellows and opposite said output valve positioned further away from said swivel means.

13. Metering pump dispenser according to claim 12, wherein: said output channel of said metering pump positioned further away from said swivel means passes through said valve cover of said metering pump positioned closest to said swivel means.

14. Metering pump dispenser according to claim 1, wherein: said pump housing has a front wall and each of said intake valves are an element of said front wall.

15. Metering pump dispenser according to claim 14, wherein: said front wall of said pump housing has first and second dome-shaped cylinder means for uptake from said respective communication bellows, said first and second dome-shaped cylinder means being formed in one piece with said front wall, and said first and second dome-shaped cylinder means each forming a seperating wall with an intake seat for said respective intake valves, said seperating walls and said intake seats being positioned on a side of said front wall with said communication bellows.

16. Metering pump dispenser according to claim 15, wherein: each of said intake seats have a tube segment conically tapering to the respective first and second supply chambers, and a substantially cylindrical intake tube is connected to each of said tube segments.

17. Metering pump dispenser according to one of claim 16, wherein each of said intake valves have an intake valve disk as a moveable valve organ, said intake valve disks are provided with guide ribs, said intake valve disks being guided in an axially moveable manner in said respective intake tubes.

18. Metering pump dispenser according claim 17, wherein: each of said intake valve seats are provided with safety catches which project into said respective communication bellows, said safety catches have stop means, directed radially inward, for bounding an opening stroke of said respective intake valve disks.

19. Metering pump dispenser according to claim 17, wherein: each of said valve disks are provided with a central mounting pin projecting into said respective communication bellows.

20. Metering pump dispenser according to claim 16, wherein: each of said intake tubes is provided with an outer thread means for screwing on a supply container.

21. Metering pump dispenser according to claim 15, wherein: each of said first and second dome-shaped cylindrical means is provided with an inner thread means for screwing on a supply container.

22. Metering pump dispenser according to claim 1, wherein: said pump housing defines two separate substantially cylindrical hollow spaces having openings on an underside for uptake of exchangeable supply containers.

23. Metering pump dispenser according to claim 22, wherein: said two hollow spaces have a depth adapted to a length of said supply containers.

24. Metering pump dispenser according to claim 1, wherein: said head part of said pump housing is provided on an upper edge with a stop edge which projects inside said pump housing.

25. Metering pump dispenser according to claim 1, wherein: said common actuating device has a stop shoulder on a housing side.

26. Metering pump dispenser according to claim 1, wherein: said swivel means has a tongue-and-groove joint shape.

27. Metering pump dispenser according to claim 1, wherein: said swivel means consists of rods arranged in said head part of said pump housing and catch cavities are arranged on an underside of said common actuating device, said rods being latchable in a rotatable manner into said catch cavities.

28. Metering pump dispenser according to claim 27, wherein: several demountable rods are arranged in series and parallel to a stop edge of said common actuating device, said several demountable rods being made in one piece in a bearing piece formed on a front wall of said pump housing, said bearing piece being substantially positioned in said substatially common plane of symmetery of said first and second metering pumps.

29. Metering pump dispenser according to claim 28, wherein: said catch cavities are arranged in pairs coaxially in two catch pieces running substantially parallel to said substantially common plane of symmetry on an underside of said common actuating device, a number and distances of said catch cavities correspond to those of said rods of said bearing piece.

30. Metering pump dispenser according to claim 27, wherein: a bearing piece has one of catch cavities and cross boreholes and that one of said catch cavities of said bearing piece is joined in a demountable manner by means of a loose bearing pin, with a pair of said catch cavities which are positioned substantially opposite, said loose bearing pin means being part of said swivel means.

31. Metering pump for dispensing media, the pump comprising:

a pump housing containing first and second supply chambers, said pump housing having a head part;

first and second pump means for dispensing the media from said respective first and second supply chambers when activated, said first and second pump means being positioned in said pump housing, a magnitude of the media dispensed from each of said first and second pump means being proportional to a degree of activation of each of said first and second pump means;

actuating means for substantially simultaniously actuating said first and second pump means at varing degrees of activation, said actuating means having an actuating lever connected to said pump housing and extending across said first and second pump means, said actuating means having a swivel means for pivotably connecting said actuating lever to one side of said pump housing about a swivel axis, said actuating means actuating said first and second pump means by lever movements of said actuating lever about said swivel axis, said one side of said pump housing being spaced further away from said second pump means than said first pump means for activating said second pump means at a different degree than said first pump means, said swivel means having swivel position means for varying a distance from said swivel axis to said first and second metering pumps in order for said actuating lever to vary a ratio between a degree of activation of said first pump means and a degree of activation of said second pump means.

* * * * *